US009511918B2

(12) United States Patent
Allen et al.

(10) Patent No.: US 9,511,918 B2
(45) Date of Patent: Dec. 6, 2016

(54) SELF-LOCKING CONTAINER

(75) Inventors: Ira L. Allen, Dallas, TX (US); Lawrence A. Clevenger, LaGrangeville, NY (US); Kevin S. Petrarca, Newburgh, NY (US); Carl J. Radens, LaGrangeville, NY (US)

(73) Assignee: International Business Machines Corporation, Armonk, NY (US)

( * ) Notice: Subject to any disclaimer, the term of this patent is extended or adjusted under 35 U.S.C. 154(b) by 793 days.

(21) Appl. No.: 13/340,776

(22) Filed: Dec. 30, 2011

(65) Prior Publication Data

US 2013/0168395 A1 Jul. 4, 2013

(51) Int. Cl.

| | |
|---|---|
| ***B65D 79/02*** | (2006.01) |
| ***B65D 55/10*** | (2006.01) |
| ***B65D 41/04*** | (2006.01) |
| *A61J 1/03* | (2006.01) |

(52) U.S. Cl.

CPC ..... *B65D 79/02* (2013.01); *B65D 55/10* (2013.01); *A61J 1/03* (2013.01); *A61J 2200/72* (2013.01); *B65D 41/04* (2013.01); *B65D 2213/00* (2013.01)

(58) Field of Classification Search

USPC ..... 220/288, 326, DIG. 17, DIG. 32, 203.22,220/203.23

See application file for complete search history.

(56) References Cited

U.S. PATENT DOCUMENTS

| | | | | |
|---|---|---|---|---|
| 3,338,455 | A | 8/1967 | Miller | |
| 4,927,049 | A * | 5/1990 | Giordano | 220/201 |
| 6,574,166 | B2 | 6/2003 | Niemiec | |
| 6,997,043 | B2 | 2/2006 | Swanson et al. | |
| 7,114,371 | B2 | 10/2006 | Swanson et al. | |
| 7,209,042 | B2 | 4/2007 | Martin et al. | |
| 7,455,668 | B2 * | 11/2008 | Petrakis | 604/890.1 |
| 7,513,384 | B2 * | 4/2009 | Morris, Sr. | 220/302 |
| 7,517,146 | B2 | 4/2009 | Smith et al. | |
| 7,891,310 | B2 | 2/2011 | Taylor et al. | |

* cited by examiner

*Primary Examiner* — Fenn Mathew
*Assistant Examiner* — Jennifer Castriotta
(74) *Attorney, Agent, or Firm* — Jeffrey L. Streets

(57) ABSTRACT

Method and apparatus to provide a self-locking container to prevent unwanted access to materials stored in the container as a result of exposure to conditions that compromise the effectiveness or safety of the materials. A container may be threaded to receive a threaded lid, and the container may comprise a bolt movable within a channel from a retracted position, which allows the lid to be threadably connected or removed, to a locked position, which prevents removal of the lid. The bolt is movable to the locked position by a drive member, such as a bimetallic strip or a shape-memory element that drive the bolt in response to exposure to the condition that compromises the material.

20 Claims, 13 Drawing Sheets

FIG. 10

SELF-LOCKING CONTAINER

BACKGROUND OF THE INVENTION

1. Field of the Invention

The present invention relates to a self-locking container or package that prevents access to materials or the operations of a device due to exposure to an environmental condition or combination of conditions.

2. Background of the Related Art

Some prescription medications lose their effectiveness or become unsuitable for consumption upon exposure to elevated temperatures. Various containers are available for prevention of child access to the contents, but these containers do nothing to prevent access to materials that may be compromised as the result of exposure to environmental conditions that may render the materials harmful or ineffective.

BRIEF SUMMARY OF THE INVENTION

One embodiment of the present invention provides an apparatus comprising a container having a top, an adjacent external thread and a channel intermediate the top and the thread, a lid having a top surface, an adjacent lip with an internal thread and a recess intermediate the top surface and the thread, a bolt movable within the channel of the container from a retracted position withdrawn from the recess to a locked position protruding into the recess, and a temperature sensitive drive member to move the bolt from the retracted position to the locked position, wherein exposure to a predetermined threshold temperature with the lid threadably coupled to the container causes the drive member to engage and move the bolt from the retracted position to the locked position to prevent rotation and unthreading of the lid from the container.

Another embodiment of the invention provides an apparatus comprising a container having a top, an adjacent internal thread and a recess intermediate the top and the thread, a lid having a top surface, an external threaded portion and a channel intermediate the external threaded portion and the top surface, a bolt movable within the channel of the lid from a retracted position withdrawn from the recess to a locked position protruding into the recess, and a temperature sensitive drive member to move the bolt from the retracted position to the locked position, wherein exposure to a predetermined threshold temperature with the lid threadably coupled to the container causes the drive member to engage and move the bolt from the retracted position to the locked position to prevent rotation and unthreading of the lid from the container.

DETAILED DESCRIPTION OF THE INVENTION

Figure 1:
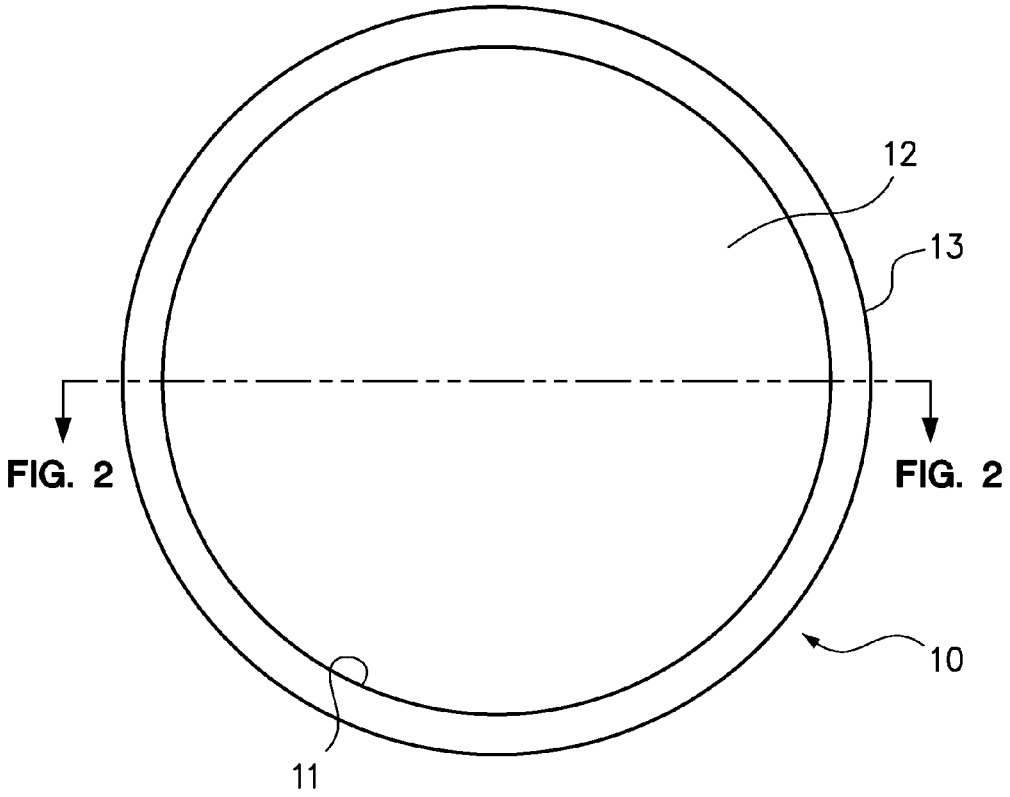
FIG. 1 is a plan view of the underside of a lid that is a component of one embodiment of the apparatus of the present invention.

One embodiment of the present invention provides an apparatus comprising a lid having a top surface, a lip with an internal thread and a recess intermediate the top surface and the thread, a container having a top, an external thread and a channel, and a bolt movable within the channel from a retracted position to a locked position protruding into the recess of the lid. Optionally, the channel may comprise a plurality of channel teeth and the bolt comprises a plurality of bolt teeth, and the channel teeth and the bolt teeth are directionally staggered to facilitate movement of the bolt from the retracted position to the locked position. The embodiment of the apparatus further comprises a drive member disposed adjacent to an interior end of the bolt to move the bolt from the retracted position to the locked position within the channel. The lid may be threadably coupled to the container by rotation of the lid in a first direction to engage the internal thread on the lip of the lid with the external thread on the container, and the lid may be threadably decoupled from the container by rotation of the lid in a second direction, opposite the first direction.

A second embodiment of the present invention provides an apparatus comprising a lid having a top surface, a protruding portion with an external thread thereon and a channel intermediate the top surface and an end of the protruding portion, a container having a top, an internal thread adjacent to the top and a recess intermediate the internal thread and the top, a bolt movable in the channel of the lid from a retracted position to a locked position with at least a portion of the bolt received in the recess. Optionally, the channel may comprise a plurality of channel teeth and the bolt comprises a plurality of bolt teeth, and the channel teeth and the bolt teeth are directionally staggered to facilitate movement of the bolt from the retracted position to the locked position. The second embodiment further comprises a drive member disposed adjacent to an interior end of the bolt to move the bolt from the retracted position to the locked position. The lid may be threadably coupled to the container by insertion of the protruding portion of the lid into the container and by rotating the lid in a first direction to engage the external thread on the protruding portion of the lid with the internal thread on the container, and the lid may be threadably decoupled from the container by rotation of the lid in a second direction, opposite the first direction.

The second embodiment may additionally comprise a lid having an aperture in the top of the lid immediately adjacent the channel, and the bolt comprises an indicator surface disposed upwardly towards the aperture in the top so that the indicator surface on the bolt can be seen through the aperture in the top of the lid. The indicator surface may comprises a first color on a first portion and a second color on a second portion such that, when the bolt is in the retracted position, the first portion is visible through the aperture in the lid and when the bolt is moved to the locked position, the second portion is visible through the aperture in the lid to alert the user that the materials within the container have been exposed to the environmental condition that causes self-locking of the container. It will be understood that such an indicator could be used in containers that do not self-lock.

It will be understood that the drive member, the bolt and the channel may be disposed either on a lid or on a container, and that space restrictions may be considered in the optimization of the apparatus. For example, disposing these components on the lid may enable the mouth of the container to remain open and unobstructed, whereas disposing these components on the container may enable the lid to remain simple and inexpensive to manufacture. It will be further understood that the embodiments illustrated in the appended drawings may be adapted for being disposed on the lid or the container.

In some embodiments of the present invention, the drive member may comprise a bimetallic strip having a base, an unrestrained end and first strip element joined to a second strip element there between. The bimetallic strip is disposed with the unrestrained end adjacent to an interior end of the bolt and with the base of the bimetallic strip coupled to the component of the apparatus having the channel. It will be understood that the component of the apparatus having the channel and supporting the base of the bimetallic strip may be either the container or the lid, depending on the embodiment of the apparatus. The unrestrained end of the bimetallic strip deflects at elevated or lowered temperatures due to a substantial difference in the coefficient of thermal expansion of the first strip element relative to the coefficient of thermal expansion of the adjoining second strip element. Deflection of the unrestrained end of the bimetallic strip at elevated or lowered temperatures engages the interior end of the bolt and moves the bolt within the channel from the retracted position to the locked position.

In other embodiments of the present invention, the drive member may comprise a shape-memory element that has been cold worked and disposed on the apparatus to engage and move the bolt within the channel from the retracted position to the locked position. A shape-memory element such as a wire may be elongated (cold worked) and disposed on the apparatus with a deviated portion of the shape-memory element disposed adjacent to an interior end of the bolt. A simple embodiment of the present invention may comprise a shape-memory element comprising a first end coupled to a first anchor and a second end coupled to a second anchor with the deviated portion there between and adjacent to the interior end of the bolt. At an elevated temperature, the shape-memory element would contract, the deviated portion would engage and displace the bolt within the channel from the retracted position to the locked position. In an alternate embodiment of the present invention having a shape-memory element, the shape-memory element may comprise a ring or band that has been cold worked and then received on a C-shaped retainer on the apparatus with a deviated portion disposed adjacent to an interior end of the bolt. It will be understood that this configuration will provide a substantially longer overall length of the shape-memory element "trigger" and more overall contraction at the deviated portion to displace the bolt within the channel. At a predetermined elevated temperature, the shape-memory element contracts and the C-shaped retainer causes the overall contraction in the shape-memory element to be taken from the deviated portion. This arrangement provides for greater displacement of the bolt within the channel than the previously described embodiment of the present invention using a shape-memory element to engage and displace the bolt from the retracted position to the locked position.

It will be appreciated that the use of the temperature-activated drive members described herein provides a fail safe self-locking container that cannot be opened after the container (and the contents) are exposed to temperatures at or above the activation temperature at which the drive member reacts. The drive member may be selected for the application; that is, a drive member for a first self-locking apparatus to contain a first material may comprise a first metallurgical compound having a first activation temperature corresponding to the temperature at which the first material is compromised, and another drive member for a second self-locking apparatus to contain a second material may comprise a second metallurgical compound having a second activation temperature corresponding to the temperature at which the second material is compromised.

A bimetallic strip will deflect in the opposite direction as a result of exposure to extreme cold; that is, while a bimetallic strip will deflect towards the side having the metal strip with the lesser of the two coefficients of thermal expansion upon exposure to elevated temperatures, the bimetallic strip will deflect towards the side with the higher of the two coefficients of thermal expansion (or, in this case, thermal contraction) upon exposure to very low temperatures. It will be understood that the embodiment of the present invention using the bimetallic strip as a "trigger" sensitive to elevated temperatures may also be used as a "trigger" sensitive to low temperatures by utilizing the reliable deflection of a bimetallic strip in the other direction as a drive member to activate a self-locking mechanism upon exposure of materials stored in a container to extreme cold or freezing temperatures.

The drive member may be made from various materials that are able to actuate and move the bolt to lock the container. Although much of the discussion has focused on temperature sensitive materials, the drive member may also be humidity sensitive or shock sensitive. A specific drive material may be selected for a specific application. For example, a specific material may be selected for use that will cause deflection at or around the same conditions, such as temperature or humidity that will cause damage to the contents of the container.

In an alternate embodiment of the present invention, the drive member may comprise a hydrophilic material. Humidity and/or moisture can cause expansion of a hydrophilic material, such as polyurethane foam. An apparatus utilizing this alternate type of drive member may, in one embodiment, comprise a container having a hydrophilic material disposed within a permeable or semi-permeable member disposed adjacent to an interior end of the bolt and with the hydrophilic material disposed intermediate the interior end of the bolt and a stop wall. It will be understood that the component of the apparatus having the channel and stop wall may be either the container or the lid, depending on the embodiment of the apparatus. The hydrophilic material expands upon exposure to humidity or moisture. The stop wall limits movement of the expanding hydrophilic material in a first direction and redirects expansion of the hydrophilic material towards and against the interior end of the bolt. Displacement of the interior end of the bolt moves the bolt within the channel from the retracted position to the locked position. In one embodiment of the apparatus using a hydrophilic material as the drive member, the hydrophilic material may be disposed within an open-ended containment member such as a sleeve having a plurality of holes to ensure exposure of the hydrophilic material to the humid air or moisture to which the drive member may be exposed. The open-ended containment member may be formed of a variety of materials such as metal, plastic or glass.

In another embodiment of the apparatus of the present invention, a component of the drive member assembly may be comprised of a volatile material, such as iodine/zinc/napthalene, disposed in a sealed fragile vial that is, in turn, disposed within an expandable member. The fragile vial containing the volatile material isolates the volatile material from an activating material, such as water, outside the vial but within the expandable member. Exposure of the vial to an acceleration sufficient to rupture the vial disposes the volatile material in reactive contact with the activating material to produce gas to expand the expandable member. It will be understood that, by placing such a drive member adjacent the interior end of the bolt, the apparatus will become self-locking when exposed to acceleration sufficient to rupture the vial.

In a related embodiment, a volatile material is disposed in close proximity to a fragile vial containing an activation material and a dense mass. The volatile material will, upon rupture of the vial, be exposed to the activation material to produce a reaction to produce gas to expand an expanding member in which the volatile material and the vial are disposed. Upon subjecting the apparatus to an acceleration sufficient to cause the mass to break the vial, the volatile material is disposed in reactive contact with the activation material to produce gas and expand the expandable member. The expandable member is disposed intermediate a stop wall and the interior end of the bolt to expand and displace the bolt within the channel from the retracted position to the locked position.

Embodiments of the present invention having a drive member to displace the bolt from the retracted to the locked position may comprise an additional feature to prevent the bolt from returning to the retracted position if the drive member is restored to or towards its original configuration upon cooling or heating. One embodiment of the present invention comprises an apparatus having a bolt with a series of directionally staggered teeth along one or more sides of the bolt and a channel with a series of channel teeth to cooperate with the bolt teeth. The bolt teeth and channel teeth function as a linear ratchet in which the activated drive member "ratchets" the bolt from the retracted position to a locked position within the linear ratchet to dispose a portion of the bolt into a recess. The linear ratchet made up by the bolt, the bolt teeth, the channel and the channel teeth prevent the bolt from retreating from the locked position if the drive member disengages the bolt due to cooling.

In a related embodiment, the bolt may be retained in the locked position by use of glass transition materials that soften to allow movement of the bolt within the channel from the retracted position to the locked position at elevated temperatures, and that later harden to "cement" the bolt in the locked position within the channel after cooling. Examples of glass transition materials that can be used for this application include polyethylene terephthalate, polyvinyl alcohol and polyvinyl acetate.

Engineered plastics may also be used as a temperature-sensitive drive member. For example, in one embodiment, a plastic drive member may be hot-molded to a desired shape, allowed to cool, then warmed and deformed to an intermediate shape prior to being installed (in the deformed state) as the drive member adjacent to a bolt disposed in a retracted position within a channel. Upon exposure to elevated temperature corresponding to the transition temperature of the plastic, the drive member will displace the bolt to the locked position within the channel as it is restored to or towards its original pre-deformation shape.

In an embodiment for protecting against unwanted electronic access to data or processing capacity available through an electronic apparatus, the bolt may be made of a conductive material that is movable, using a drive member, between a (retracted) open circuit position to a (locked) closed circuit position in which the conductive bolt engages a grounded member to close a ground circuit and disable the electronic device. In this manner, the drive member may be selected to provide the specific environmental condition that disables and prevents access to the data or processing capacity that would be otherwise available through the electronic device.

Drive members may, in some embodiments, comprise single-event activated drive members such as, for example, the fragile vials containing an activating material or volatile material, and drive members may, in other embodiments, comprise time-and-exposure activated drive members such as, for example, the bimetallic or shape memory material strips containing dissimilar thermally expanding materials and the shape-memory elements comprising metals that contract (return) to an original configuration upon sufficient exposure to a transition temperature. It should be understood that the embodiments illustrated in the appended drawings are merely examples of embodiments using these types of drive members are not meant to provide an exhaustive inventory of suitable drive members that can be used to activate the locking structures of embodiments of the present invention. Additional materials that comprise time-and-exposure activated drive members include, but are not limited to, glass transition materials, polymetric materials, quartz and crystallized silica.

FIG. 1 is a plan view of the underside of a lid 10 that is a component of one embodiment of the apparatus of the present invention. The lid 10 is generally circular and has an interior surface 12, a lip 13 protruding from the lid 10, and an internal thread 11 within the lip. The lid 10 may be made of any suitable material including, but not limited to, plastic or metal.

Figure 2:
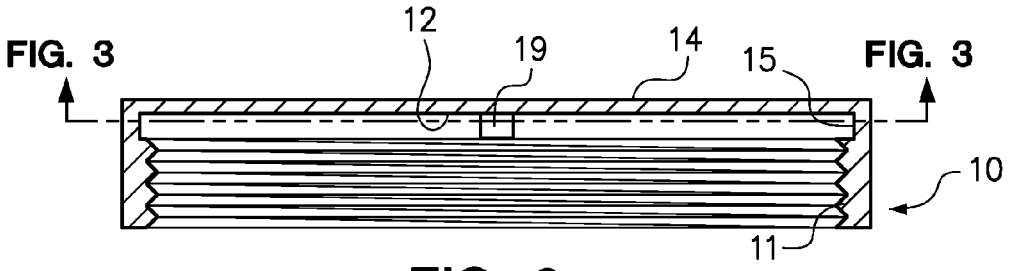
FIG. 2 is a section view of the lid of FIG. 1 revealing a recess within a circumferential portion of the lid.

FIG. 2 is a section view of the lid 10 of FIG. 1 revealing the recess 15 disposed on the lip 13 intermediate the internal thread 11 and the interior surface 12. The recess 15 has a larger diameter than the inside diameter of the internal thread 11. The lid 10 also has an exterior surface 14 opposite the interior surface 12. At least one tab 19 is disposed within the recess 15.

Figure 3:
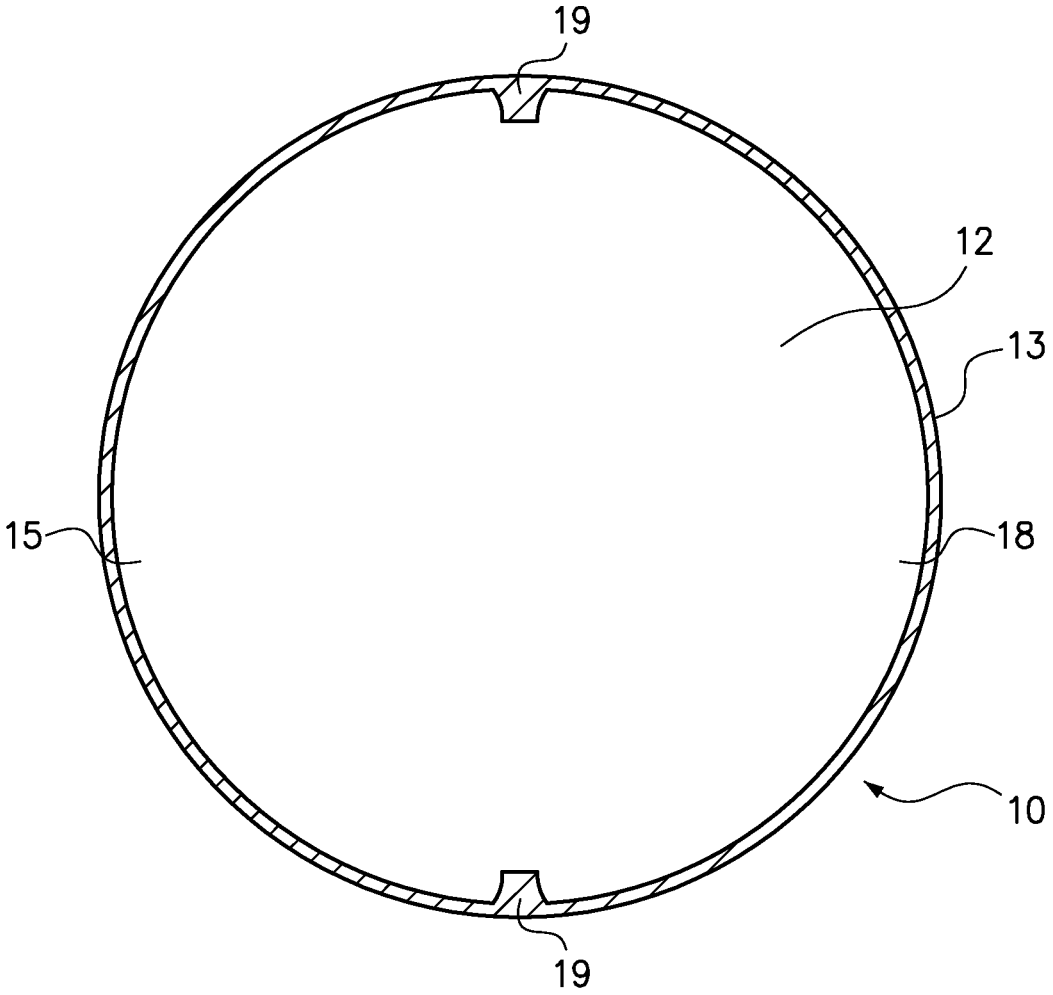
FIG. 3 is a section view of the lid of FIGS. 1 and 2 through the circumferential portion and recess.

FIG. 3 is a section view of the lid 10 of FIGS. 1 and 2 taken through a circumferential portion 18 of the lip 13 that includes the recess 15. The lid 10 of FIG. 3 comprises two tabs 19 that divide the circumferential portion 18 of the lid 10 in which the recess 15 lies into two recesses 15. The circumferential portion 18 may be divided into any number of recesses using an equal number of tabs 19, which are preferably spaced apart at equal angles.

Figure 4:
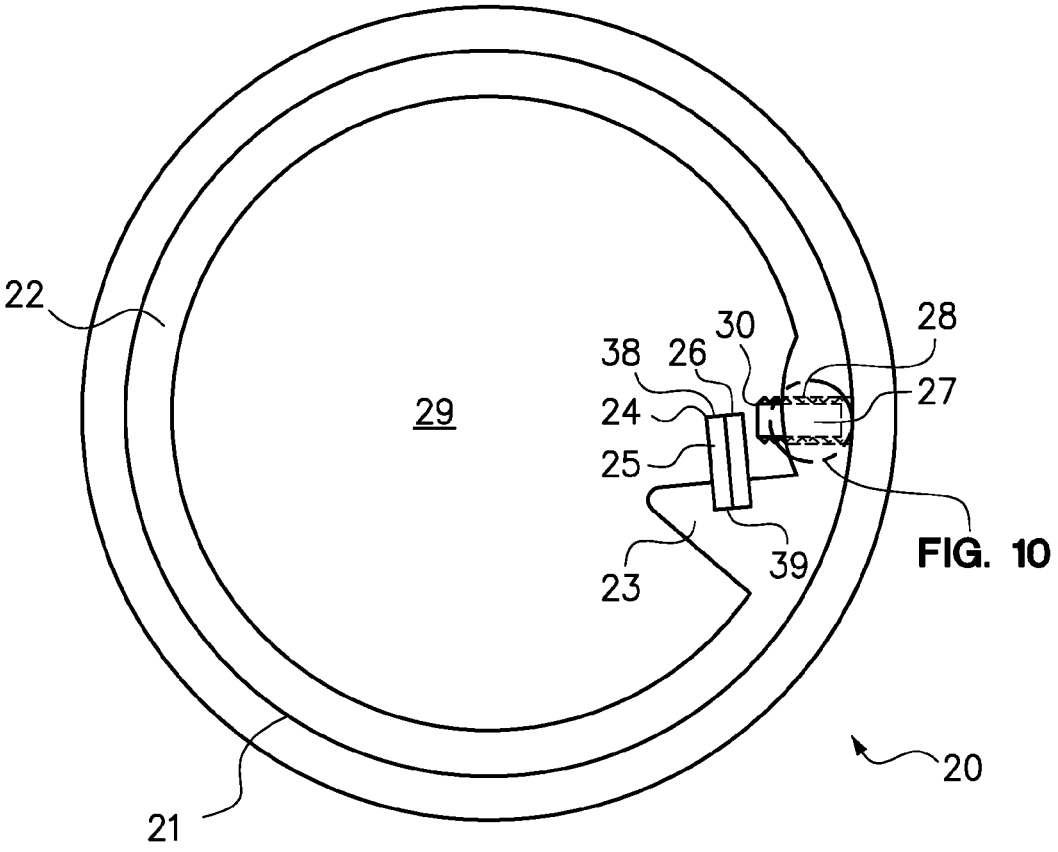
FIG. 4 is a plan view of a container of the present invention compatible with the lid of FIGS. 1-3.

FIG. 4 is a plan view of a container 20 that is a component of one embodiment of the apparatus of the present invention that is compatible with the lid 10 of FIGS. 1-3. FIG. 4 illustrates a container 20 having an interior floor 29, a top 22, an external thread 21, a channel 28, a bolt 27 movable within the channel 28, and a drive member 24 comprising a bimetallic strip. The bimetallic strip 24 comprises a first strip member 25 of a first metallic material adjoined to a second strip member 26 of a second metallic material different from the first metallic material. The bimetallic strip 24 has a first end 39 coupled to the container 20 at a base 23 and an unrestrained end 38 disposed adjacent to an interior end 30 of the bolt 27.

Figure 5:
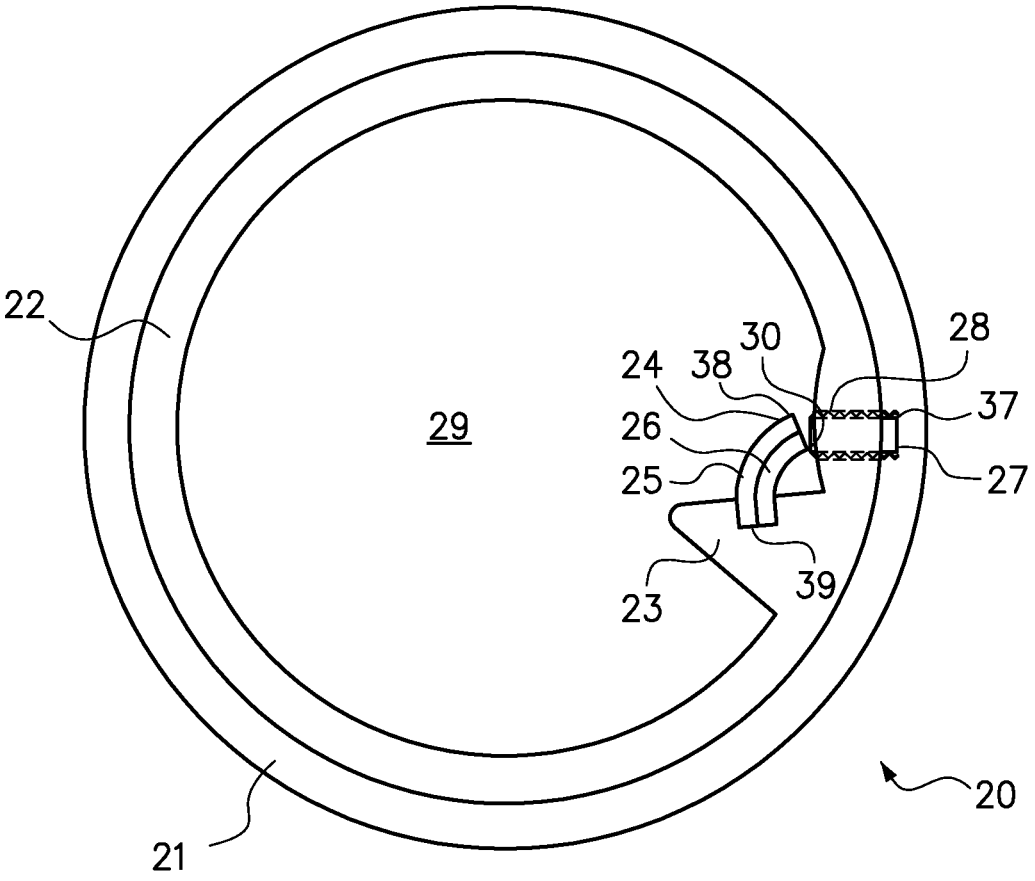
FIG. 5 is the plan view of FIG. 4 after exposure to an elevated temperature to activate the drive member to automatically lock the container to the lid.

FIG. 5 is the plan view of FIG. 4 after exposure to an elevated temperature to activate the drive member 24. The bimetallic strip 24 is illustrated as being deflected towards the side of the bimetallic strip 24 having the second strip member 26 and away from the side of the bimetallic strip 24 having the first strip member 25. The first end 39 being held by the base 23, the deflection of the bimetallic strip 24 causes the unrestrained end 38 to move the bolt 27 within the channel 28 from the position illustrated in FIG. 4 to the position illustrated in FIG. 5, after which a distal end 37 of the bolt 27 protrudes from the channel 28 to a position above the external thread 21 of the container 20.

Figure 6:
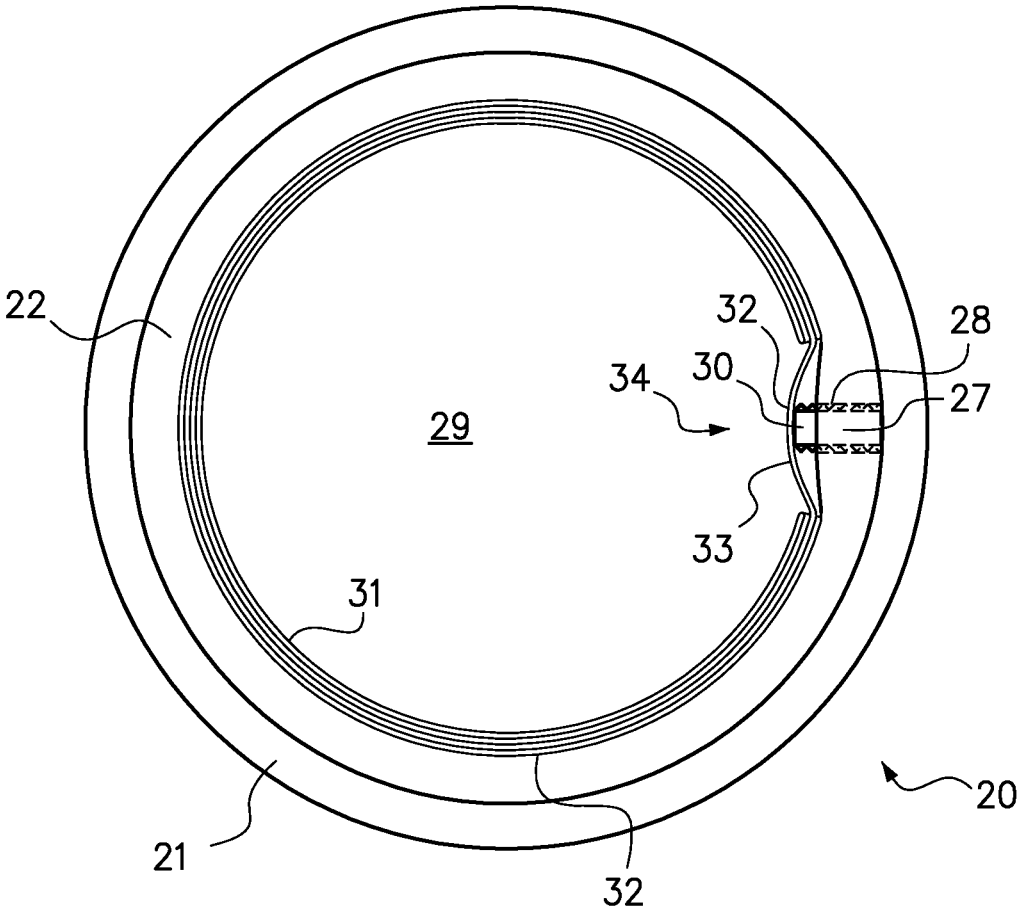
FIG. 6 is a plan view of an alternative container of the present invention compatible with the lid of FIGS. 1-3.

FIG. 6 is a plan view of an alternative container 30 that is a component of one embodiment of the apparatus of the present invention that is also compatible with the lid 10 of FIGS. 1-3. The container 20 of FIG. 6 also comprises a top 22, an external thread 21, and a bolt 27 movably disposed within a channel 28. The container 20 of FIG. 6 further comprises a generally C-shaped retainer 31 to engage a drive member 32. The C-shaped retainer may be coupled to the interior of the container 20 or, alternately, to the interior side of the lid for the container 20. The drive member 32 of FIG. 6 is a shape-memory element that has been cold worked, prior to installation, to the configuration illustrated in FIG. 6, and the cold working of the shape-memory element included stretching of the ring-shaped shape-memory element 32 to be received on the retainer 31 with a deviated portion 33 disposed adjacent to an interior end 30 of the bolt 27 received within the channel 28. It will be understood that the shape-memory element 32 will, upon being heated to an elevated temperature sufficient to activate the shape-memory element 32, contract in length to the approximate length of the shape-memory element 32 prior to being cold worked and installed on the retainer 31.

Figure 7:
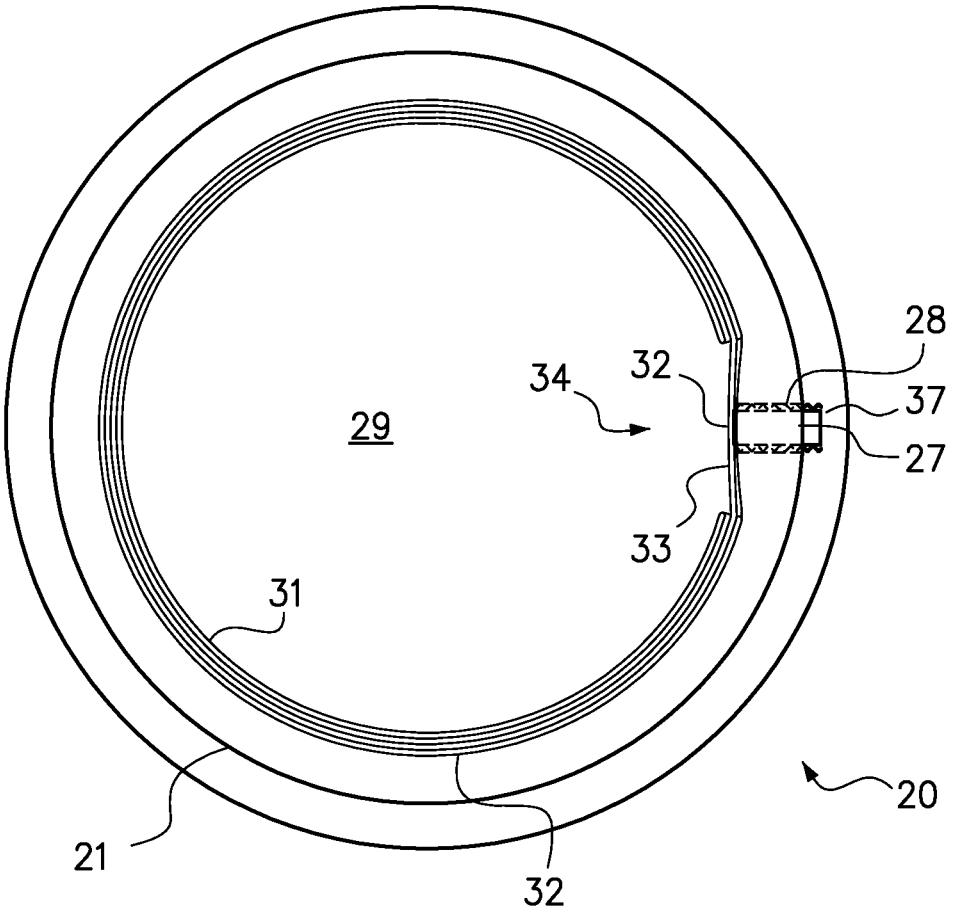
FIG. 7 is the plan view of FIG. 6 after exposure to an elevated temperature to activate the drive member to lock the container to the lid.

FIG. 7 is the plan view of FIG. 6 after exposure of the container 20 to an elevated temperature to activate the drive member 32, which is a shape-memory element. The shape-memory element 32 remains on the retainer 31, which has not changed in size. The shape-memory element 32 is illustrated in FIG. 7 in a contracted configuration causing the deviated portion 33 to engage and displace the bolt 27 from the retracted configuration of FIG. 6 to a locked configuration corresponding to displacement of the bolt 27 within the channel 28 to dispose exterior distal end 37 above the external thread 21.

Figure 8:
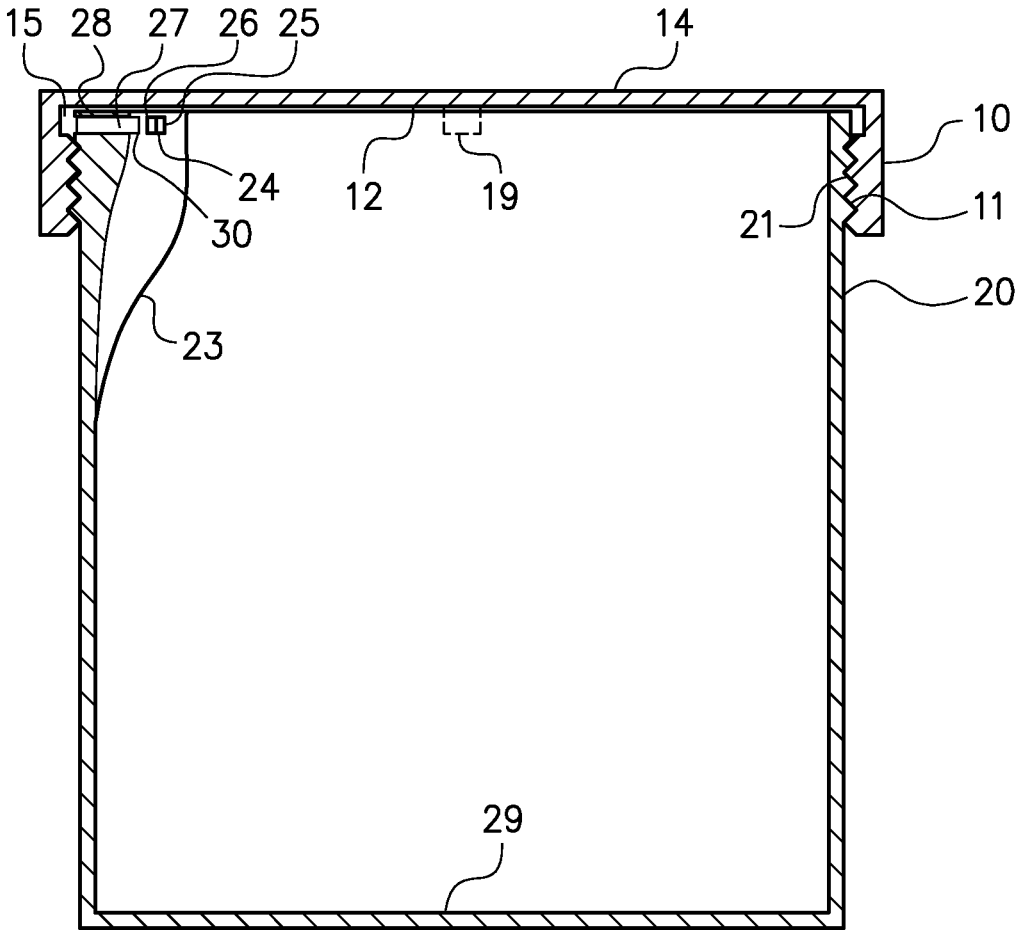
FIG. 8 is a section view of an apparatus of the present invention comprising the lid of FIGS. 1-3 threadably received onto the container of FIG. 4.

FIG. 8 is a section view of an apparatus comprising the lid 10 of FIGS. 1-3 threadably received onto the container 20 of FIG. 4 to dispose the bolt 27 within the channel 28 adjacent to and aligned with the recess 15 of the lid 10. The lid 10 is secured to the container 20 by mating engagement of internal thread 11 of the lid 10 with the external thread 21 of the container 20. The drive member 24 remains disposed adjacent to the proximal end 30 of the bolt 27 with the second strip member 26 of a second metallic material adjoined to the first strip member 25 of a first metallic material, the latter being disposed adjacent to the interior end 30 of the bolt 27. It will be understood that a temperature sensitive material 50 may be contained within the apparatus comprising the container 20 and lid 10. Rotation of the lid 10 to unthread the lid 10 from the container 20 will cause tab 19 to move past the retracted bolt 27.

Figure 9:
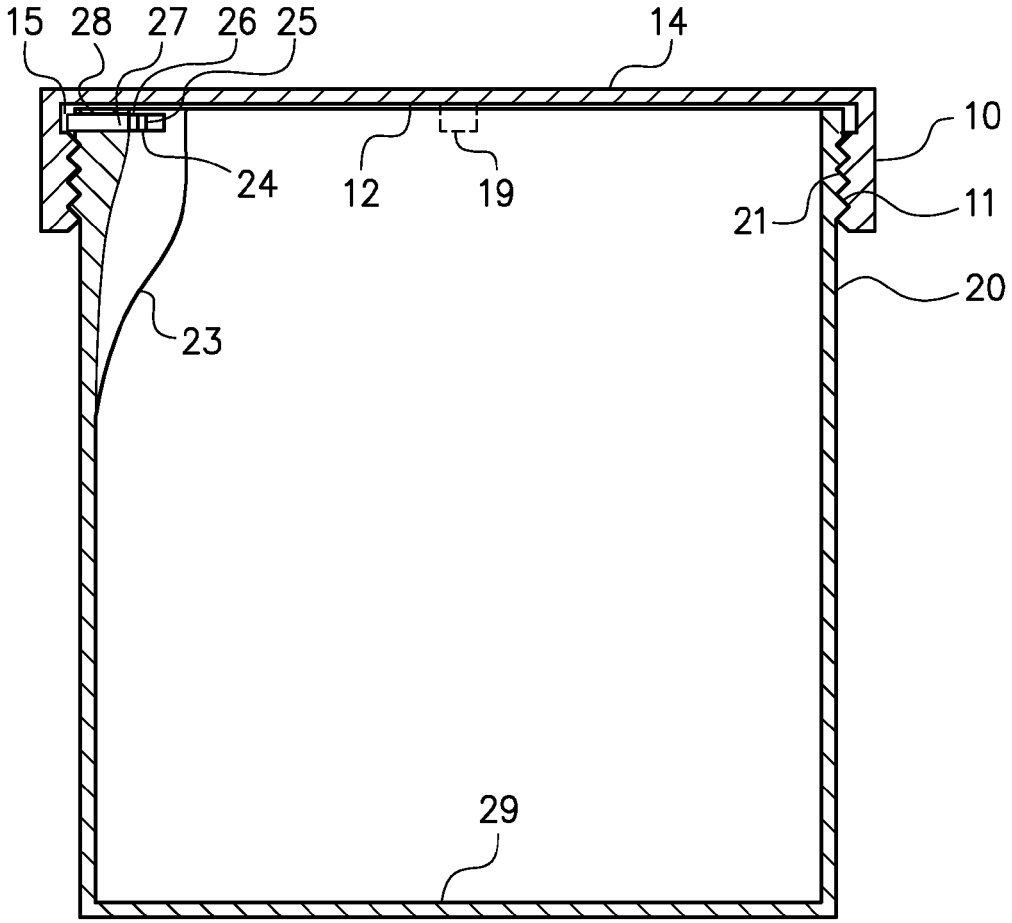
FIG. 9 is the section view of the apparatus of FIG. 8 after exposure to an elevated temperature to activate the drive member.

FIG. 9 is the section view of the apparatus of FIG. 8 after exposure to an elevated temperature sufficient to cause the bimetallic strip 24 to deflect towards the side of the bimetallic strip 24 having the second strip element 26 and away from the side of the bimetallic strip 24 having the first strip element 25. The deflection of the bimetallic strip 24 causes the unrestrained end 38 of the bimetallic strip 24 to engage and move the bolt 27 from the retracted configuration of FIG. 8 to the locked configuration illustrated in FIG. 9 with exterior distal end 37 of the bolt 27 disposed within the recess 15 of the lid 10. It will be understood that an attempted removal of the lid 10 from the container 20 by rotating the lid 10 to unthread the internal thread 11 of the lid 10 from the external thread 21 of the container 20 causes the distal end 37 of the bolt 27 to engage and stop a tab 19 (not shown in FIG. 9—see FIG. 3) thereby preventing removal by preventing further rotation of the lid 10. Rotation of the lid 10 to unthread the lid 10 from the container 20 will cause tab 19 to engage the bolt 27 and obstruct removal of the lid 10 from the container 20.

Figure 10:
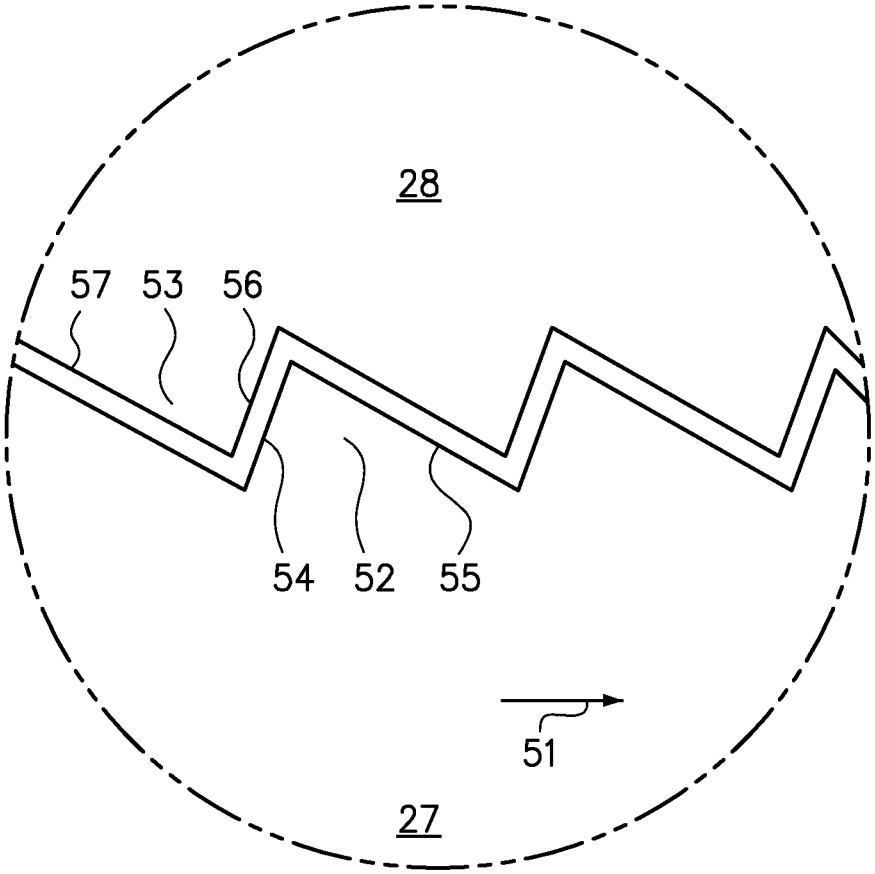
FIG. 10 is an enlarged view of a portion of the bolt and channel of FIG. 4.

FIG. 10 is an enlarged view of a portion of the bolt 27 and channel 28 of FIG. 4 showing directionally staggered teeth 52 disposed along the bolt 27 and in mating engagement with directionally staggered teeth 53 on the inside surface of the channel 28. Each tooth 52 on the bolt 27 comprises a steep side 54 and a shallow side 55 and each tooth 53 on the channel 28 comprises a corresponding steep side 56 and a shallow side 57. It will be understood that the directionally staggered arrangement of the teeth 52 on the bolt 27 and teeth 53 on the channel 28 will facilitate movement of the bolt 27 relative to the channel 28 and in the direction of the arrow 51, and that the arrangement will, at the same time, oppose movement of the bolt 27 in the direction opposite to the arrow 51 to prevent the bolt 27 from retreating from its displaced position illustrated in FIGS. 5, 7 and 9. It will be further understood that the angles of the steep sides 54, 56 and shallow sides 55 and 57 may vary in other equally effective embodiments.

Figures 11, 12:
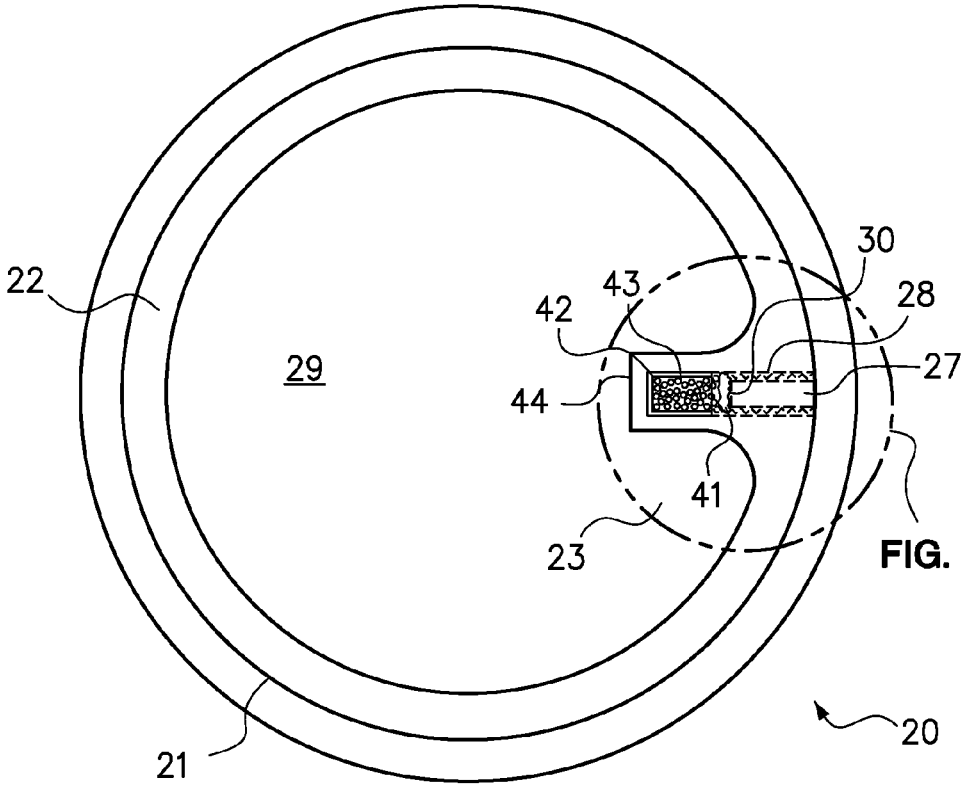
FIG. 11 is a plan view of an alternative container of the present invention compatible with the lid of FIGS. 1-3.
FIG. 12 is an enlarged plan view of the alternative container of FIG. 11 after exposure of the container to moisture or humidity sufficient to activate the hydrophilic trigger mechanism.
Figure 12:
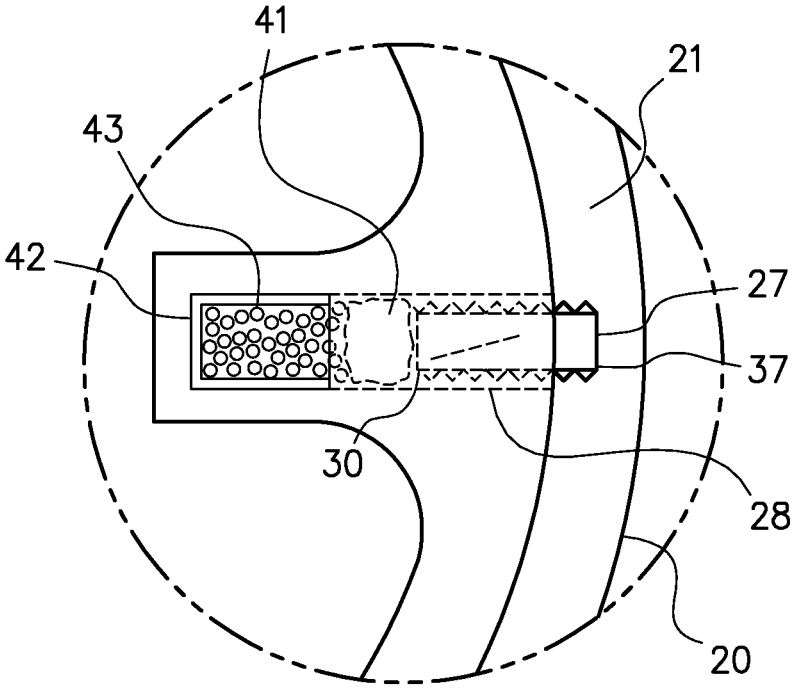

FIG. 11 is a plan view of an alternative container 20 of the present invention compatible with the lid 10 of FIGS. 1-3. The container 20 of FIG. 11 comprises a top 22, an external thread 21 and a channel 28 to receive a bolt 27 movable between a retracted position (shown in FIG. 11) and a locked position. The container 20 further comprises a hydrophilic material 41 disposed adjacent an interior end 30 of the bolt 27. The hydrophilic material 41 is, in the embodiment of FIG. 11, disposed within a generally rigid sleeve 42 having a plurality of apertures 43 for disposing the hydrophilic material in exposure to air within the interior 29 of the container 20. A shoulder 49 may be used to secure the sleeve 42 containing the hydrophilic material 41 in position adjacent to the interior end 30 of the bolt 27.

FIG. 12 is an enlarged plan view of the alternative container of FIG. 11 after exposure of the container to moisture or humidity sufficient to activate the hydrophilic material 41. The activated hydrophilic material 41 swells upon exposure to sufficient humidity and/or moisture to displace the engage the interior end 30 of the bolt 27 and to displace the bolt 27 within the channel 28 to the position in FIG. 12 with an outer end 37 of the bolt 27 disposed above the thread 21 on the container 20. It will be understood that the lid 10 of FIGS. 1-3 is not shown in FIG. 12 for purposes of exposing the self-locking mechanism, and that self-locking mechanism is adapted to dispose the outer end 37 of the bolt 27 within the recess 15 (see FIG. 2) of the lid 10 to lock the lid 10 onto the container 20.

Figures 13, 14:
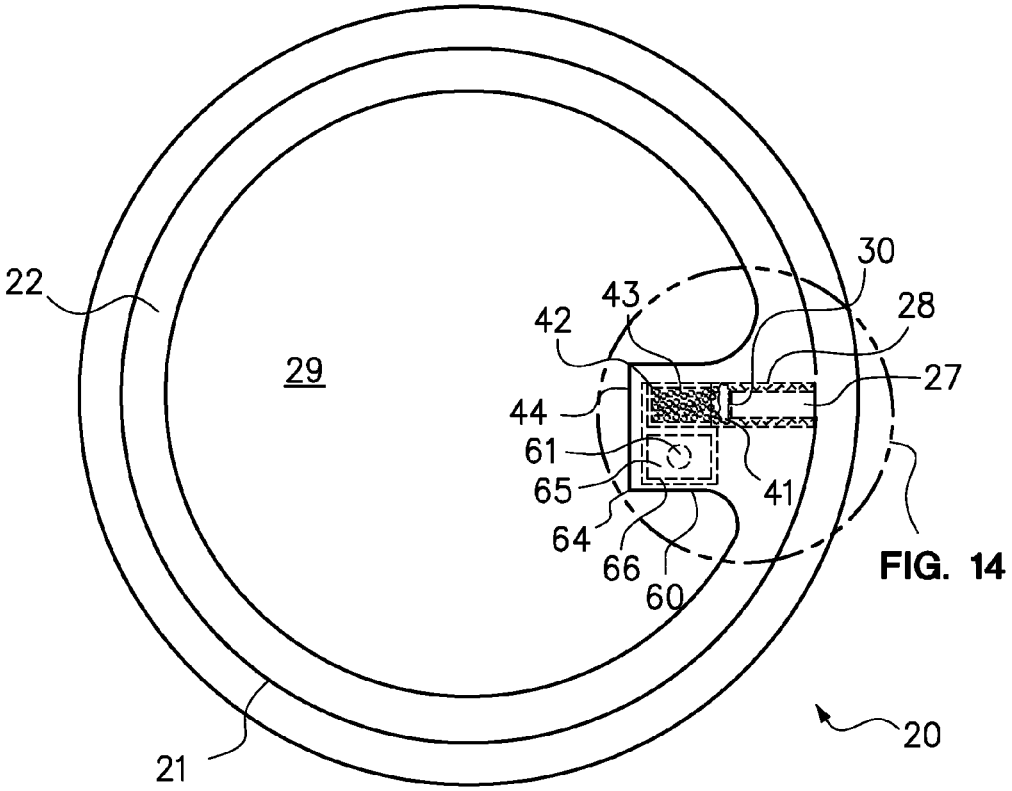
FIG. 13 is a plan view of an alternative container of the present invention compatible with the lid of FIGS. 1-3.
FIG. 14 is an enlarged plan view of the alternative container of FIG. 13 after exposure of the container to excessive acceleration/deceleration sufficient to rupture the vial containing the reactive material.
Figure 14:
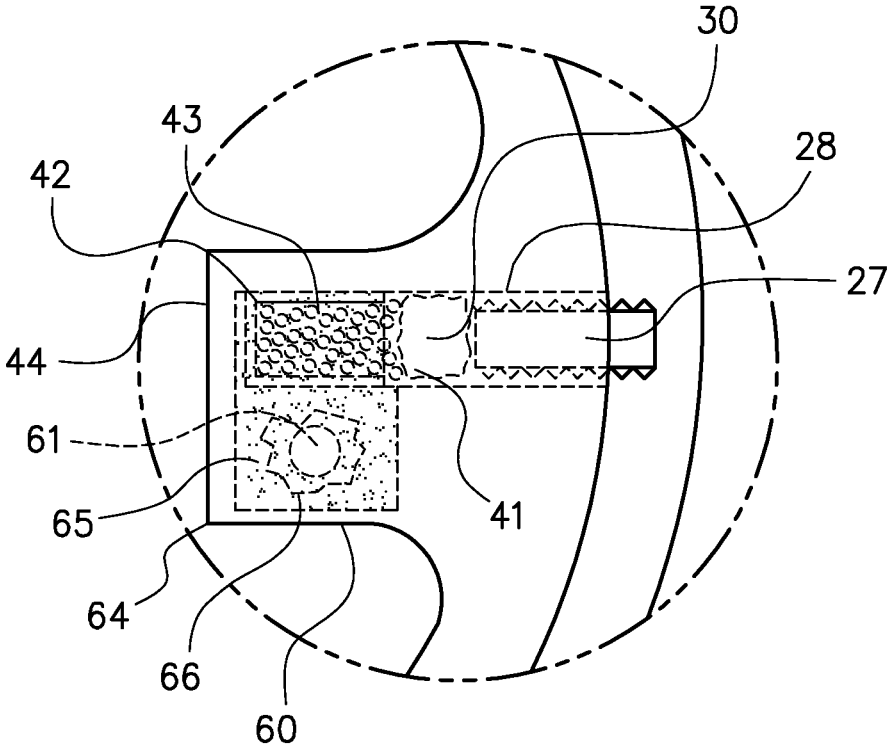

FIG. 13 is a plan view of an alternative container 20 of the present invention compatible with the lid 10 of FIGS. 1-3. The container 20 comprises an interior 29, a top 22, a thread 21 and a cavity 60 defined by a barrier 64 disposed adjacent a channel 28 with a bolt 27 movably received therein from a retracted position (shown in FIG. 13) to a locked position. The container 20 further comprises a sleeve 42 having a plurality of apertures 43 therein, the sleeve 42 containing a first material 41 that expands upon activation by an activating material. Adjacent to the sleeve 42 and within the cavity 60 is a fragile vial 66 containing a dense mass 61 and a volume of activating material 65. It will be understood that subjecting the container 20 of FIG. 13 to sufficient acceleration/deceleration will cause the mass 61 to impact the vial 66 and break the vial 66 to release the activating material 65 therein to engage and activate the first material 41 within the adjacent sleeve 42.

FIG. 14 is an enlarged plan view of the container 20 of FIG. 13 after exposure of the container 20 to excessive acceleration/deceleration sufficient to rupture the vial 66 and to release the activating material 65. The activated first material 41 is illustrated as having expanded to engage and displace the bolt 27 within the channel 30 from the retracted position illustrated in FIG. 13 to the locked position illustrated in FIG. 14 with the outer end 37 disposed above the thread 21 of the container 30 and, when the lid of FIGS. 1-3 is threadably secured to the container 20, with the outer end 37 disposed within the recess 15 of the lid 10.

It will be understood that a variety of combinations of first materials and activating materials can be used in the alternative embodiment of FIGS. 13 and 14 to produce the displacement of the bolt 27 within the channel 28. In some embodiments, the increase in volume may be obtained by use of an expandable member, such as latex or rubber, to form the cavity 60. This embodiment having an expandable cavity member 60 could be used with, for example, a small amount of sodium as a first material and water as the activating material or, alternately, a small amount of sodium bicarbonate as a first material and water as the activating material. Many other combinations of first materials and activating materials may be used to implement embodiments of the present invention and the present invention is limited only by the claims that follow.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus, comprising:

a container having a top, an adjacent external thread and a channel intermediate the top and the thread;

a lid having a top surface, an adjacent lip with an internal thread and a recess intermediate the top surface and the thread;

a bolt movable within the channel of the container from a retracted position withdrawn from the recess to a locked position protruding into the recess; and a drive member to move the bolt from the retracted position to the locked position;

wherein exposure to a predetermined threshold temperature with the lid threadably coupled to the container causes the drive member to engage and move the bolt from the retracted position to the locked position to prevent rotation and unthreading of the lid from the container.

2. The apparatus of claim 1, wherein the recess of the lid comprises a circumferential groove having a tab therein.

3. The apparatus of claim 1, wherein the bolt comprises teeth to engage teeth within the channel.

4. The apparatus of claim 3, wherein the teeth on the bolt and the teeth on the channel are disposed to facilitate movement of the bolt from the retracted position to the locked position and to resist movement of the bolt from the locked position towards the retracted position.

5. The apparatus of claim 1, wherein the drive member is a bimetallic strip disposed adjacent an interior end of the bolt to deflect upon exposure to an elevated temperature to move the bolt within the channel.

6. The apparatus of claim 1, wherein the drive member is a shape-memory element disposed adjacent to an interior end of the bolt to contract upon exposure to an elevated temperature to move the bolt within the channel.

7. The apparatus of claim 6, wherein the shape-memory element forms an expanded wire ring disposed on a ring retainer on the container.

8. The apparatus of claim 7, wherein the shape-memory element comprises a deviated portion disposed adjacent to the interior end of the bolt;

wherein exposure of the shape-memory element to an elevated temperature causes the shape-memory element to deform to move the deviated portion against the interior end of the bolt.

9. The apparatus of claim 6, wherein the shape-memory element is a length of wire having a first end secured to the container at a first anchor and a second end secured to the container at a second anchor, and a deviated portion disposed therebetween and adjacent to the interior end of the bolt;

wherein exposure of the shape-memory element to an elevated temperature causes the shape-memory element to deform to move the deviated portion against the interior end of the bolt.

10. The apparatus of claim 6, wherein the shape-memory element is a length of wire having a first end secured to the container at a first anchor and a second end secured to the container at a second anchor, and a deviated portion disposed there between and adjacent to the interior end of the bolt, and wherein exposure of the shape-memory element to an elevated temperature causes the shape-memory element to contract to move the deviated portion against the interior end of the bolt.

11. The apparatus of claim 1, wherein the lid comprises an aperture in the top surface to expose a first portion of the bolt in the retracted position and a second portion of the bolt in the locked position.

12. The apparatus of claim 11, wherein the first portion of the bolt is a first color and the second portion of the bolt is a second color that can be visually distinguished from the first color.

13. An apparatus, comprising:

a container having a top, an adjacent internal thread and a recess intermediate the top and the thread;

a lid having a top surface, an external threaded portion and a channel intermediate the external threaded portion and the top surface;

a bolt movable within the channel of the lid from a retracted position withdrawn from the recess to a locked position protruding into the recess; and a temperature sensitive drive member to move the bolt from the retracted position to the locked position;

wherein exposure to a predetermined threshold temperature with the lid threadably coupled to the container causes the drive member to engage and move the bolt from the retracted position to the locked position to prevent rotation and unthreading of the lid from the container.

14. The apparatus of claim 13, wherein the recess of the container comprises a circumferential groove having a blocking member therein.

15. The apparatus of claim 13, wherein the bolt comprises teeth to engage teeth within the channel.

16. The apparatus of claim 15, wherein the teeth on the bolt and the teeth on the channel are disposed to facilitate movement of the bolt from the retracted position to the locked position and to resist movement of the bolt from the locked position towards the retracted position.

17. The apparatus of claim 13, wherein the drive member is a bimetallic strip disposed adjacent an interior end of the bolt to deflect upon exposure to an elevated temperature to move the bolt within the channel.

18. The apparatus of claim 13, wherein the drive member is a shape-memory element disposed adjacent to an interior end of the bolt to contract upon exposure to an elevated temperature to move the bolt within the channel.

19. The apparatus of claim 18, wherein the shape-memory element forms an expanded wire ring disposed on a ring retainer within the lid.

20. The apparatus of claim 18, wherein the shape-memory element comprises a deviated portion disposed adjacent to the interior end of the bolt, and wherein exposure of the shape-memory element to an elevated temperature causes the shape-memory element to contract to move the deviated portion against the interior end of the bolt.

* * * * *